United States Patent [19]

Randall

[11] 4,068,334

[45] Jan. 17, 1978

[54] INFLATABLE BODY SUPPORT APPARATUS

[75] Inventor: Nathan A. Randall, Tucson, Ariz.

[73] Assignees: Harry E. Grover, Deerfield, Ill.; Richard C. Ruppin, Detroit, Mich.

[21] Appl. No.: 692,793

[22] Filed: June 4, 1976

[51] Int. Cl.[2] ..... A47C 27/08

[52] U.S. Cl. ..... 5/365; 128/33; 137/624.14

[58] Field of Search ..... 5/365, 368, 369, 370, 5/371, 91; 137/624.14; 128/33

[56] References Cited

U.S. PATENT DOCUMENTS

| | | | |
|---|---|---|---|
| 2,250,325 | 7/1941 | Barnes | 5/334 R |
| 2,437,006 | 3/1948 | Simpson | 128/33 |
| 3,148,391 | 9/1964 | Whitney | 5/369 |
| 3,587,568 | 6/1971 | Thomas | 128/33 |
| 3,653,083 | 4/1972 | Lapidus | 5/347 |
| 3,971,398 | 7/1976 | Taylor et al. | 137/624.14 |

*Primary Examiner*—Paul R. Gilliam
*Assistant Examiner*—Kenneth J. Dorner
*Attorney, Agent, or Firm*—Richard C. Ruppin

[57] ABSTRACT

A body support apparatus is disclosed as having alternatingly inflatable and deflatable cells and uninflated resilient body support material positioned between the cells. The cells are inflated by pressurized fluid such as air under the control of a control device utilizing diaphragm means responsive to the pressurized fluid to determine the inflation and deflation time periods and connect and disconnect the pressurized fluid to the cells. During the time period in which the cells are inflated, the support of a body will be provided by the uninflated support material. During the time that the cells are inflated above the support level of the uninflated support material, the cells will support the body.

13 Claims, 6 Drawing Figures

INFLATABLE BODY SUPPORT APPARATUS

BACKGROUND OF THE INVENTION

This invention relates to a body support apparatus and in particular to a support pad having inflatable and deflatable cells and an inflation and deflation control therefor.

The benefits of body support apparatus utilizing support pads or mattresses having inflatable and deflatable cells are well-known. These benefits include the improvement of the blood circulation and thereby the comfort and health of the person being supported by varying the support points of the person's body and the providing of a massage to the body to also improve blood circulation and comfort.

There are, however, several drawbacks to the presently available types of inflatable and deflatable body support apparatus. One of these drawbacks is the use of two separate sets of air support cells with individual cells of each set positioned alternatingly in a side by side manner. In these arrangements, one set of cells is inflated while the other set of cells is deflated and then the procedure is reversed. Obviously, the cost and complexity is increased by the need for two separate sets of inflated cells. A U.S. Pat. No. 2,719,986 to Rand is illustrative of such a dual cell arrangement. In Lapidus U.S. Pat. No. 3,653,083, there is illustrated as one of the embodiments an arrangement in which there are two sets of inflated cells but with only one of the sets of cells being alternately inflated and deflated. The second inflated set of cells remain continuously inflated and contain a strip of flexible tubular material in each separate cell to establish a bottom limit to the depressing movement of a body on the support pad. Due to the dual cell structure and the inclusion of the flexible tube support, the Lapidus structure is also relatively complicated.

A further drawback of the present types of body support apparatus is that the inflation and deflation control devices for the support pads are quite complicated. The Rand U.S. Pat. No. 2,719,986, referenced above, is illustrative of such a control.

SUMMARY OF THE INVENTION

An important object of the present invention is to provide a simple and economical body support apparatus in which the inflation and deflation of body support cells is controlled by a novel means for connecting and disconnecting a source of pressurized air to the support cells. A further object is to provide a body support apparatus in which uninflated support material alternates with inflated support cells to support a body.

The objects of the invention are accomplished by providing a support pad of the mattress type as commonly utilized in a bed or a seat pad which may be part of any type of seat used for supporting a human body. In the preferred embodiment, the support pad is comprised of elongated, alternatingly inflatable and deflatable cells separated by strips of uninflated resilient body support material. The inflatable cells are commonly connected and inflated by a source of pressurized fluid such as air. The pressurized fluid is connected to and disconnected from the inflatable cells by a novel control device which utilizes diaphragm means responsive to the pressurized fluid to determine the inflation and deflation time periods and connect and disconnect the pressurized fluid to the cells. During the time period in which the cells are deflated the support of the body will be provided by the uninflated support material. During the time that the cells are inflated above the support level of the uninflated support material, the cells will support the body.

The foregoing and other objects and advantages of the present invention will be more clearly understood from the following detailed description thereof when read in conjunction with the accompanying drawings.

DESCRIPTION OF THE PREFERRED EMBODIMENT

Figure 1:
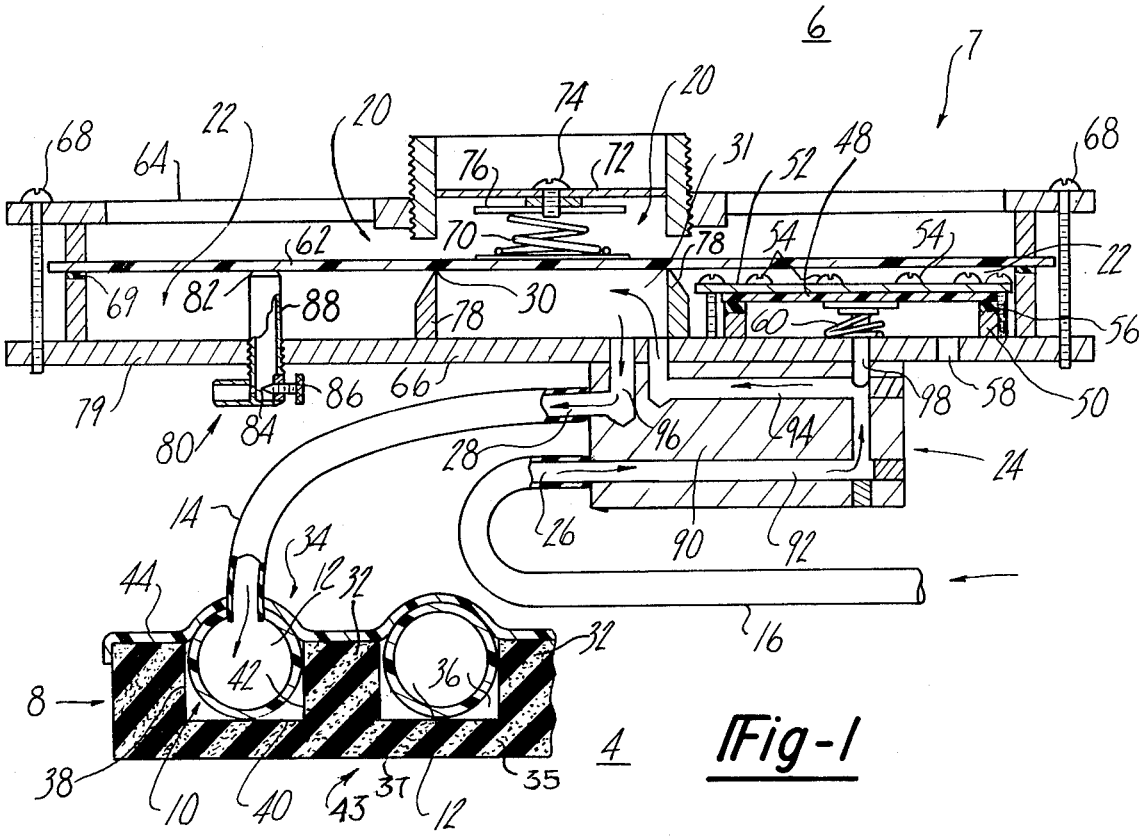
FIG. 1 is an elevation view in cross section showing a body support apparatus in a first condition.
Figure 2:
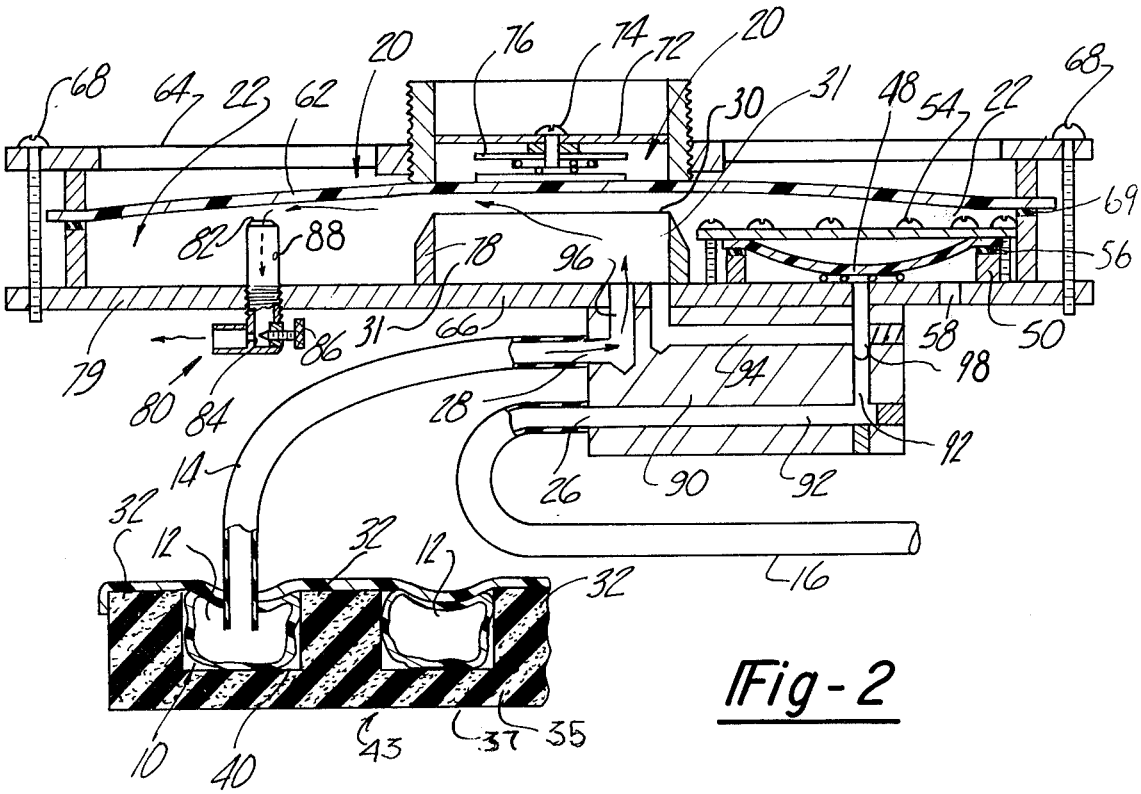
FIG. 2 is an elevation view in cross section showing the body support apparatus of FIG. 1 in a second condition.
Figure 5:
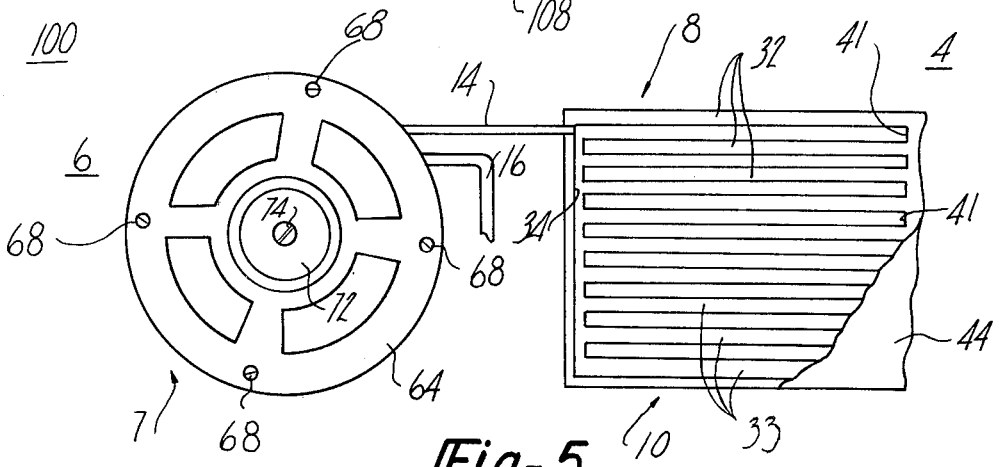
FIG. 5 is a plan view, partly broken away, showing the body support apparatus of the invention.

Referring to FIGS. 1 and 2, a body support apparatus is shown as having a control means 6 and body support member 4 including uninflated support material 8 and a cell section 10. The cell section 10 comprises a plurality of individual, connected cells 12 and the cell section 10 is connected to the control means 6 by a pressurized fluid intake and exhaust tube 14. The control means 6 is in turn connected by tube 16 to a source (not shown) of pressurized fluid such as air. The control means 6 includes a frame 7, diaphragm means 20, a chamber 22 and valve means 24. The valve means 24 has an air inlet opening 26 and an air outlet and exhaust opening 28. The valve means 24 operates, as part of the control means 6, to connect and disconnect pressurized air to the cell section 10 and the chamber inlet opening 30, as will be later described in greater detail. The uninflated support material 8 is shown in FIGS. 1, 2 and 5 as having strips of uninflated support material 32 adjacent the body supporting side 34 of member 4. The strips 32 may be integral with or form separate pieces from the test of uninflated support material 8. Also, the strips 32 may be of other configurations than the elongated, uniform height and width shapes shown in the figures. The rest of the uninflated support material 8 comprises the resilient layer 35. The resilient layer 35 has a surface 37 and defines the side 43 of the support member 4 opposite the body supporting side 34. The support material 8 forms a plurality of recesses 36 each having sidewalls 38, 40 and 42. The uninflated support material 8, including strips 32, is made of a resilient material which may be, for example, a cellular type material having either open or closed cells. As shown in the figures, the body supporting side 34 of the support number 4 is covered by a sheet of resilient material 44 which may be either a textile fabric or an elastomer.

Figure 6:
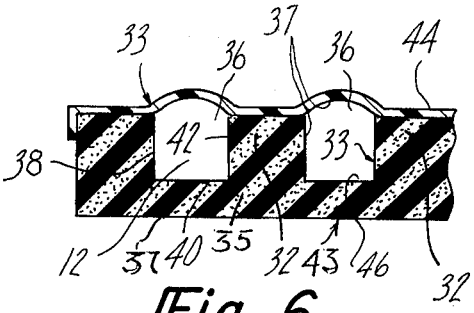
FIG. 6 is an elevation view in cross section showing a part of another embodiment of a body support apparatus.

In FIG. 6 there is shown, as part of another embodiment of the body support apparatus, a body support number 4 in which the recesses 36, the cover sheet 44 and the end walls 39 and 41 in material 8 (see FIG. 5) form the cells 33. The cells 33 perform the same function as cells 12 shown in the embodiment of FIGS. 1 and 2. In the embodiment of FIG. 6, the support material 8 including strips 32 and the cover 44 must be impermeable to air or whatever other inflating fluid is used to inflate the cells. This requirement may be met in any of several ways. For example, the uninflated support material 8 and support strips 32 may be of a closed cell material or the walls 38, 40 and 42 may be covered with a coating of air impermeable material 37. Also, the cover sheet 44 can be coated with air impermeable material 37. To form each of the discrete cells 33, the cover sheet 44 is adhered to the strip supports 32.

Referring again to FIGS. 1 and 2, the cells 12 are essentially elongated sealed tubes with the tubes having a common connection and an air connection to air inlet and exhaust tube 14. The normally inflated diameter of each of the cells 12 is such that when inflated, as shown in FIG. 1, the cells 12 extend above the strip support 32 in the direction of the body being supported so that the inflated cells 12 support the body and the support pressure regions on the body run along the length of the cells 12. When the cells 12 are in their deflated condition or mode, as shown in FIG. 2, the cells 12 collapse below or to the level of the support strips 32 such that the support strips 32 support the body and the support pressure regions on the body run along the length of strips 32. Repeated cycling of the cells 12 between an inflated and deflated mode thus causes periodic shifting of the support of the body between the support strips 32 and the cells 12. With reference to FIG. 6, the cells 33 and strips 32 alternately support the body when cells 33 are inflated and deflated in the same manner as cells 12 and strips 32 in FIGS. 1 and 2.

Referring again to the control means 6, the diaphragm means 20 includes a first diaphragm 48 mounted on a support 50 and secured in place by a retaining ring 52 and screws 54. A gasket 56 provides an air tight seal at the joint between the diaphragm 48 and the support 50. One side of the diaphragm 48 forms part of the chamber 22 and the other side of the diaphragm 48 is exposed to the atmosphere via an opening 58 in the frame 7. Resilient means such as a spring 60 bears on one of its ends against frame 7 and on its other end against diaphragm 48 and biases the diaphragm 48 against the pressure of the air within chamber 22.

The diaphragm means 20 further includes a second diaphragm 62 forming one of the walls of chamber 22. The diaphragm 62 is clamped between upper and lower portions 64 and 66 respectively of frame 7 and held secure by screws 68. A gasket 69 seals the chamber 22 from the atmosphere. Resilient means such as a spring 70 is positioned between a wall 72 of frame 7 and the diaphragm 62 and biases the diaphragm 62 against the pressure of the air within the chamber 22. The compression force applied by the spring 70 to the diaphragm 62 may be varied by adjusting screw 74 threadably mounted on wall 72 and carrying a bearing plate 76 against which the spring 70 bears. The inlet opening 30 into chamber 22 is formed of a wall member 78 against which the diaphragm 62 bears to thereby limit the maximum movement of diaphragm 62 in the direction of the chamber 22 and seal the inlet opening 30, as shown in FIG. 1. In FIG. 2, the diaphragm 62 is shown in a second position in which the pressure of the air at the inlet opening 30 has overcome the bias force of spring 70 to cause the diaphragm 62 to move away from the inlet opening 30 and permit pressurized air to enter into the chamber 22. An exhaust pipe 80 extends through the wall 79 of chamber 22 in a sealed relationship therewith and provides a passage for exhaust of pressurized air from the cells 12 via the valve means 24 and the chamber 22. When the diaphragm 62 is in its first position as shown in FIG. 1, it also bears against the main exhaust opening 82 of pipe 80 to thereby prevent loss of air within chamber 22 through the exhaust pipe 80. The exhaust pipe 80 includes an orifice 84 and a needle valve 86 for adjusting the opening size of orifice 84. The exhaust pipe 80 also has a small bleeder hole 88 to assure reduction of the pressure within chamber 22 to that of the atmosphere while the diaphragm 62 is in its first position as shown in FIG. 1. This is necessary so that air pressure residing in chamber 22 after diaphragm 62 moves to its position as shown in FIG. 1 does not cause any variation in the time required to move diaphragm 62 to its position as shown in FIG. 2 to initiate the deflation cycle of cells 12, as will be discussed in greater detail hereinafter.

The valve means 24 includes a valve block 90 having passageway means including a first passageway 92 connected to inlet opening 26 through which pressurized air flows into the valve block 90, a second passageway 94 through which pressurized air flows out of the valve block 90, and a third passageway 96 through which pressurized air flows through valve block 90 and out of opening 28 during the inflating cycle of cells 12. The valve means 24 also includes valve stem 98. In FIG. 1, the control means 6 is shown in a first condition in which the cell section 10 is in an inflating mode and in which pressurized air flow through tubes 14 and 16, in the passageways of valve block 90, and in inlet chamber 31 are as indicated by the arrows. In FIG. 2, the control means 6 is shown in a second condition in which the first passageway 92 is blocked by the valve stem 98. In this second condition of control means 6, pressurized air flows out of cells 12 through the third passageway 96 of the valve block 90, through inlet opening 30 of chamber 22, into the chamber 22 and ultimately out of chamber 22 through exhaust pipe 80 to the atmosphere. The direction of air flow in FIG. 2 is as indicated by the arrows. In FIG. 2, the cell section 10 is in a deflating mode or cycle.

The operating of the body support apparatus 2 is as follows. The inlet tube 16 is connected to a source of pressurized air or other fluid which may, for example, have a pressure at the inlet of tube 16 of between 10 and 15 p.s.i.g. The selection of the level of pressure for the air will depend on the load or weight to be carried by the cell section 10, the surface areas of the diaphragms of 48 and 62, and the bias settings and adjustment ranges of the springs 60 and 70. The changing between inflation and deflation modes of the body support apparatus is controlled by diaphragm means 20 in response to the pressurized air and in accord with the bias settings of springs 60 and 70. With reference to FIG. 1, pressurized air flows through the valve block 90 and into inlet chamber 31 and cells 12 until there is sufficient force on the diaphragm 62 due to the pressurized air to move the diaphragm 62 in an upward direction, relative to the view of FIG. 1, against the biasing force of spring 70 and open inlet 30. This movement of diaphragm 62 initiates the change of the support apparatus 2 and cells 12 from an inflation mode to a deflation mode. The apparatus 2 and cells 12 will, however, remain in the inflation mode until movement of diaphragm 48, as described below, to complete the change to the deflation mode. As a result of the opening of inlet 30, pressurized air will flow into chamber 22. Some pressurized air will be lost from chamber 22 through exhaust pipe 80, however, the loss will be small compared to the flow of air in so that the pressure of air in chamber 22 will increase towards the pressure of the pressurized air source. When the pressure in chamber 22 has built up to the point at which the force on the diaphragm 48 is sufficient to overcome the bias force of spring 60, the diaphragm 48 will move in a downward direction, relative to the view of FIGS. 1 and 2. The valve stem 98 will thus also move downwardly to block the first passageway 92 and cut off flow of pressurized air into chamber 22 and cells 12. Until this time, the support apparatus and cells 12 have been in an inflation mode and support for a body has been provided by cells 12.

When pressurized air from the pressurized source is prevented from entering chamber 22 and cells 12, the body support apparatus and cells 12 are in a deflation mode. In the deflation mode, air escapes from cells 12 into chamber 22 and pressurized air continues to escape from chamber 22 through the exhaust pipe 80, as shown in FIG. 2. Thus, at some point during the escape of pressurized air from the cells 12, support for a body will shift from cells 12 to strips 32. When the pressure in chamber 22 and in cells 12 reaches a relatively low value near that of atmospheric pressure, the diaphragm 62 will return to its lower first position as shown in FIG. 1 due to the biasing force of spring 70. Due to the much larger working surface of diaphragm 62 subject to pressurized air when it is in its second upward position, as shown in FIG. 2, the pressure on diaphragm 62 to maintain it in its upward position is much less than that required to initially raise it when the surface of diaphragm 62 exposed to pressurized air is only that of the cross section of inlet chamber 31. Diaphragm 62 will thus remain in its upward second position until the pressure in chamber 22 is very nearly that of atmospheric pressure before the spring 70 will move diaphragm 62 back to the lower position. The exact pressure value can be controlled by adjustment of screw 74. After the diaphragm 62 moves downward to close the inlet opening 30, the bleeder hole 88 in exhaust pipe 80 will continue to allow air above the pressure of atmospheric pressure to escape from chamber 22 so that chamber 22 will be at atmospheric pressure before the pressure in inlet chamber 31 again reaches a significant value above atmospheric pressure. This eliminates any influence of pressurized air within chamber 22 on the bias settings of springs 60 and 70. Subsequent to the movement of diaphragm 62 to its downward first position, the diaphragm 48 will be moved upward to its first position by the force of spring 60. The first passageway 92 is thus re-opened and pressurized air again flows through the valve block 90 and into inlet chamber 31 and cells 12 to again place the cell section 10 in an inflation mode. Upon inflation of the cells 12 to a pre-determined height above the resilient strips 32, relative to the view of FIGS. 1 and 2, the support points for a body supported by member 4 will again shift to the cells 12.

Figure 3:
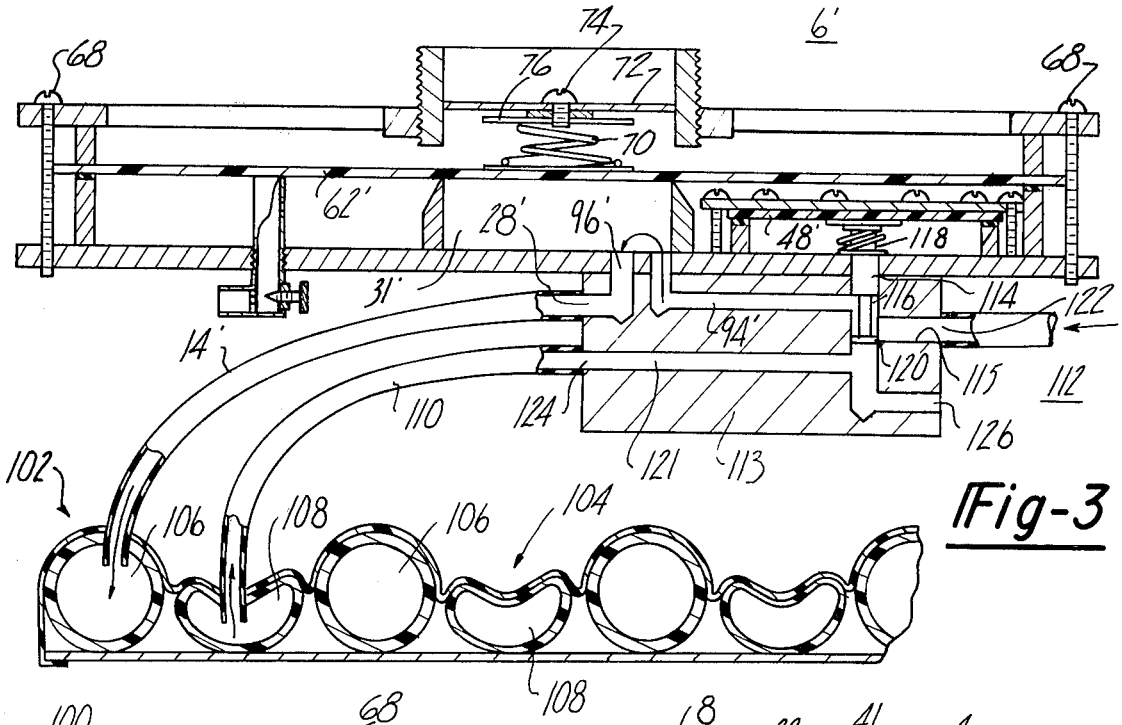
FIG. 3 is an elevation view in cross section showing another embodiment of a body support apparatus in a first condition.

In FIG. 3, another embodiment of the invention is shown in which those components identical to and functioning in substantially the same manner as the components shown in FIGS. 1 and 2 are identified by the same numeral with the addition of a prime (') designation. The body support member 100 includes a first cell section 102 and a second cell section 104. The first cell section 102 includes a plurality of first cells 106 commonly connected together and connected to an inlet and exhaust tube 14'. The second cell section 104 includes a plurality of second cells 108 commonly connected together and connected to an inlet and exhaust tube 110. A valve means 112 includes a valve block 113 and a valve stem 114 having a cut out air flow portion 116 intermediate its ends 118 and 120. The valve block 113 has an inlet 122 connected to a source of pressurized air (not shown), an outlet and exhaust opening 124 connected to tube 110, an exhaust opening 126, and an outlet and exhaust opening 28' connected to tube 14'. The valve block 113 further includes a first passageway 115 through which pressurized air enters valve block 113, a second passageway 94' through which pressurized air flows out of valve block 113, a third passageway 96' through which pressurized air goes through valve block 113 in opposite directions depending on the condition of the control means 6', and a fourth passageway 121 for exhausting of air from cell section 104. The flow of air through valve block 113 is as shown by the arrows in FIG. 3 during the inflation mode of first cell section 102 and by the arrows in FIG. 4 during the inflation mode of second cell section 104.

Figure 4:
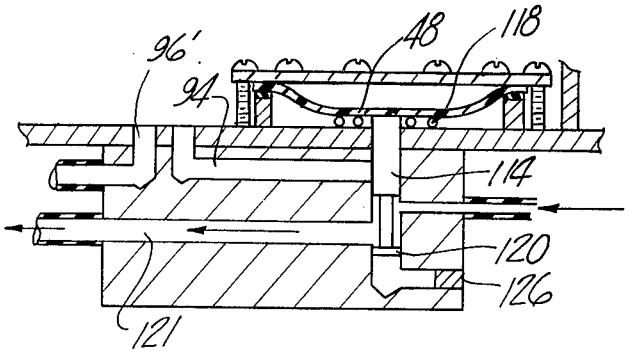
FIG. 4 is an elevation view in cross section of part of the body support apparatus of FIG. 3 in a second condition.

The operation of the body support apparatus shown in FIGS. 3 and 4 is identical to that shown in FIGS. 1 and 2 with the exception of the operation of the valve means 112 in inflating the second cell section 104 and the manner of support of a body by the cell sections 102 and 104. During the inflation mode of first cell section 102, the valve stem 114 is in a relatively upward position, similarly to the valve stem shown in FIG. 1, so that pressurized air flows through passageway 115, past air flow portion 116 of valve stem 114 and into inlet chamber 31' and first cells 106. At the same time, fourth passageway 121 is open to exhaust opening 126 so that pressurized air from the second cells 108 can exhaust to the atmosphere. After sufficient pressurized air flows into inlet chamber 31' to cause upward movement of diaphragm 62' and subsequent downward movement of diaphragm 48' and valve stem 114, pressurized air will exhaust from cells 106 and pressurized air will flow through inlet 122 and pass air flow portion 116 of stem 114 into cells 108, as shown in FIG. 4. Thus, as cell sections 102 and 104 alternately assume inflation and deflation modes, the support regions for a body supported by support member 100 shifts between cells 106 and 108.

The body support apparatus of the invention thus provides support for a body in which the support regions periodically shift from one area to another to thereby improve the comfort of the body being supported. The control means for the support apparatus is relatively simple and requires for its operation and control only the pressurized fluid used for the support member of the overall apparatus. The support member also is relatively simple and provides, in the preferred embodiment of the invention, only a single inflatable and deflatable cell section.

It will be understood that the foregoing description of the embodiments of the present invention is for the purpose of illustration only, and that the various structural and operational features as herein disclosed are susceptible to a number of modifications and changes none of which entail any departure from the spirit and scope of the invention as defined in the hereto appended claims.

What is claimed is:

1. In a body support apparatus connected to a source of pressurized fluid, the combination comprising:

a plurality of inflatable and deflatable cells providing support for a body while in an inflated condition;

control means in communication with said cells and said source of pressurized fluid for alternatingly inflating said cells by connecting said source of pressurized fluid to the cells and deflating the cells; and a plurality of uninflated, spaced apart, support strips providing support for said body while said cells are in a deflated condition, said uninflated support strips each having first and second facing sides comprising side walls of one of said cells.

2. The combination according to claim 1 further comprising a body support member including said cells and uninflated strips and having a body supporting side, a side opposite to said supporting side, and a layer of resilient support material adjacent to said strips and cells and defining said opposite side, said layer of resilient support material having a plurality of third sides each connected between a first and second side of an uninflated support strip, each first, second and connecting third side forming sides of one of said inflatable and deflatable cells.

3. The combination according to claim 1 further comprising a body support member including said cells and strips and having a sheet of substantially non-cushioning material defining a body supporting side of the body support member, said sheet of non-cushioning material having a plurality of sides each connected between two of the facing sides of the uninflated support strips and each comprising a side wall of one of said cells.

4. The combination according to claim 1 wherein the first and second sides of said uninflated support strips have a coating of air impermeable material.

5. The combination according to claim 1 wherein said uninflated support strips comprise a resilient cellular material having closed cells.

6. In a body support apparatus connected to a source of pressurized fluid, the combination comprising:

a plurality of inflatable and deflatable cells providing support for a body while in an inflated condition, said cells being inflatable by the source of pressurized fluid; and control means communicating with said cells and said source of pressurized fluid and having diaphragm means for controlling the connection of the source of pressurized fluid to said cells, said diaphragm means being responsive to the pressurized fluid in said cells to connect the pressurized fluid source to the cells.

7. In a body support apparatus including a source of pressurized fluid, the combination comprising:

a plurality of body support cells having an inflation mode and a deflation mode, said cells being in an inflation mode when connected to said source of pressurized fluid;

control means connected to said source of pressurized fluid and to said cells, said control means being responsive to said pressurized fluid to move between a first condition in which said source of pressurized fluid and a portion of said plurality of cells are connected and a second condition in which the source of pressurized fluid and said portion of the plurality of cells are disconnected, said control means including, a first diaphragm positioned for alternating engagement and disengagement with said pressurized fluid, said first diaphragm being movable to first and second positions in response, respectively, to disengagement with the pressurized fluid and engagement with said pressurized fluid, a second diaphragm movable between a first position blocking said pressurized fluid from flowing into engagement with the first diaphragm and a second position permitting said pressurized fluid to flow into engagement with the first diaphragm, and a valve connected to the source of pressurized fluid and the plurality of cells, said valve engaging the first diaphragm and being movable between first and second positions with said first diaphragm, said valve connecting the source of pressurized fluid and the portion of the plurality of cells when in its first position and disconnecting the source of pressurized fluid and the portion of the plurality of cells when in its second position.

8. The combination according to claim 7 further comprising:

a chamber; and wherein said second diaphragm comprises a wall of said chamber, said chamber being open to the entrance of said pressurized fluid when the second diaphragm is in its second position and closed to the entrance of pressurized fluid when the second diaphragm is in its first position.

9. The combination according to claim 8 wherein:

said chamber has an inlet opening in communication with the valve;

said second diaphragm is in closing engagement with the opening when in its first position and spaced from the opening when in its second position; and said valve has a passageway between the connection to the source of pressurized fluid and the inlet opening of the chamber, said passageway having an open condition when the valve is in its first position and a closed condition when the valve is in its second position whereby said valve controls the flow of pressurized fluid into engagement with the second diaphragm.

10. The combination according to claim 6 wherein the control means has a condition in which at least a portion of said cells and the diaphragm means are connected and the portion of the cells and the source of pressurized fluid are simultaneously disconnected.

11. The combination according to claim 6 wherein said control means includes a vent passageway in communication with said cells and a diaphragm movable between a first position blocking said vent passageway and a second position in which the vent passageway is open whereby venting of pressurized fluid in said cells is controlled by the position of the diaphragm.

12. The combination according to claim 6 wherein said control means includes:

a chamber having an inlet in communication with the source of pressurized fluid and said cells;

a first diaphragm positioned within said chamber and being movable in response to the pressurized fluid;

valve means responsive to movement of the first diaphragm for respectively connecting and disconnecting said cells and the source of pressurized fluid; and a second diaphragm comprising a wall of said chamber and being movable between a first position blocking said inlet and a second position in which said inlet is open, whereby flow of pressurized fluid into the chamber and into contact with the first diaphragm is controlled by the second diaphragm.

13. In a body support apparatus connected to a source of pressurized fluid, the combination comprising:

a plurality of inflatable and deflatable cells providing support for a body while in an inflated condition, said cells being inflatable by the source of pressurized fluid and deflatable by venting the cells to the atmosphere; and control means communicating with said cells and said source of pressurized fluid and having diaphragm means for controlling the venting of said cells and the connection of the source of pressurized fluid to said cells, said control means including a pressurized fluid vent and a pressurized fluid passageway in communication with the vent and the diaphragm means.

* * * * *